United States Patent [19]

Campen

[11] 4,278,054

[45] Jul. 14, 1981

[54] IGNITION TIMING

[75] Inventor: Kenneth W. Campen, Kiel, Wis.

[73] Assignee: Tecumseh Products Company, Tecumseh, Mich.

[21] Appl. No.: 923,997

[22] Filed: Jul. 12, 1978

[51] Int. Cl.[3] ..... F22B 7/06

[52] U.S. Cl. ..... 123/146.5 A; 123/149 C; 123/149 D

[58] Field of Search ..... 123/146.5 A, 149 C, 123/149 D; 403/338, 373; 310/209

[56] References Cited

U.S. PATENT DOCUMENTS

| | | | |
|---|---|---|---|
| 1,816,552 | 7/1931 | Trusler | 74/440 |
| 2,404,617 | 7/1946 | Wilkenson | 123/146.5 A |
| 3,145,036 | 8/1964 | Blum | 403/378 |
| 3,187,213 | 6/1965 | Seidl et al. | 310/209 |
| 3,192,439 | 6/1965 | Shaw | 123/146.5 A |
| 3,554,179 | 1/1971 | Burson | 123/146.5 A |
| 4,030,466 | 6/1977 | Lace | 123/146.5 A |

*Primary Examiner*—Charles J. Myhre
*Assistant Examiner*—R. A. Nell
*Attorney, Agent, or Firm*—Albert L. Jeffers; Roger M. Rickert

[57] ABSTRACT

An ignition timing method and apparatus for presetting the ignition timing of an internal combustion engine having a rotatable shaft and a wheel supported on that shaft carrying a portion of the ignition system with another portion of that ingition system supported by the engine in a relatively fixed position adjacent the wheel. A slot is provided in the shaft surface generally parallel to the axis of rotation of that shaft and a further slot is provided along an inner hub of the wheel so as to be generally alignable with the shaft slot when the wheel is supported on the shaft. A selected one of several different keys is captured between the wheel hub and the shaft so that a portion of the selected key occupies the shaft slot and another portion of the selected key occupies the wheel slot to thereby fix the angular relationship between the shaft and wheel at an angular offset determined by the particular key selected. Typically both the engine driven shaft and the wheel hub are matingly tapered with the hub keyway being wider than the shaft keyway so that with any of the selected keys the hub slot will span the shaft slot but the two slots will be offset by differing amounts as determined by the selected key. A particular key is associated with a particular type ignition system so that the engine and its keywayed shaft along with the wheel and its keywayed hub may be employed with any of several different ignition systems so long as the key associated with a particular ignition system is used to join the wheel and shaft. The key itself in cross-section along a plane generally perpendicular to the axis of rotation of the shaft is generally T-shaped with the vertical portion of the T intended to occupy the shaft slot while the upper horizontal portion of the T is intended to occupy the hub slot. The T is asymmetrical in the sense that the T base joins the T upper cross member at other than the center of that cross member. One T might be symmetrical in cross-section while another might have its vertical portion displaced toward the right and yet a third might have its vertical portion displaced toward the left, giving three or more different possible ignition timing angles, depending upon the T configuration chosen.

12 Claims, 10 Drawing Figures

IGNITION TIMING

BACKGROUND OF THE INVENTION

The present invention relates generally to the presetting of ignition timing for internal combustion engines and more particularly to an ignition timing method and apparatus adaptable to a number of different ignition systems on otherwise substantially similar engine arrangements requiring a minimum number of components peculiar to the particular ignition arrangement.

In the world of small internal combustion engines, it is commonplace to encounter ignition arrangements having one portion rotatably supported on an engine flywheel with another ignition portion fixedly supported by the engine and in close proximity to the flywheel supported portion. The same basic engine may be manufactured and sold with several different ignition options or one ignition arrangement may be obsoleted by an improved ignition, in each case requiring some parts peculiar to the particular ignition system employed. From a manufacturing as well as from a spare parts supply point of view, the number of parts peculiar to a particular ignition system should be minimized.

Exemplary flywheel ignition arrangements for small internal combustion engines are illustrated, for example, in U.S. Pat. Nos. 3,490,426 and 3,952,712, wherein a flywheel has a permanent magnet or a section of ferromagnetic material disposed in a certain region of its periphery and closely adjacent thereto a fixed ignition coil arrangement is supported on the engine, for example interior of the flywheel periphery, so that as the flywheel rotates, carrying with it the ferro-magnetic or permanent magnet segment, that segment repeatedly passes the ignition coil inducing a voltage therein for ultimately providing the ignition spark at an appropriate time in the engine cycle. Timing for such exemplary systems may of course be changed by physically displacing the fixed ignition coil, however, such physical displacement is often inconvenient and sometimes impossible.

SUMMARY OF THE INVENTION

Among the several objects of the present invention may be noted the provision of an improved arrangement for presetting the ignition timing for a small internal combustion engine; the provision of an engine manufacturing technique allowing the use of the same basic engine components with a number of different engine ignition systems; the provision of an engine manufacturing technique as set forth in the previous object characterized by minimal spare parts stocking requirements; the provision of a flywheel supported on a rotatable shaft with the relative angular orientation between the flywheel and the shaft being selectively determinable according to the particular one of several different asymmetrical keys for interconnecting the shaft and flywheel; the provision of a wheel hub and shaft keying arrangement effective only when the hub and shaft are joined along respective mating tapers for locking the wheel and shaft in any selected one of a plurality of relative angular positions; the provision of a plurality of differing keys, any one of which may join a hub keyway and a shaft keyway and each one of which provides a different relative angular orientation between the wheel hub and the shaft; the provision of differing but interchangeable offset keys for presetting an ignition timing system; and an improved keying arrangement for selectively locking a wheel to a shaft at a preferred relative position. These as well as other objects and advantageous features of the present invention will be in part apparent and in part pointed out hereinafter.

In general, a method of presetting the ignition timing of an internal combustion engine wherein a portion of the ignition system is fixedly supported by the engine while another ignition system portion moves with a wheel about an engine driven shaft includes providing a slot in the shaft surface extending generally parallel to the axis of rotation of that shaft and providing a slot in the wheel along an inner hub thereof and generally alignable with the shaft slot when the wheel is supported on the shaft. One of a plurality of keys having differing offset amounts is then selected and assembled with the wheel and shaft, with one part of the selected key occupying the shaft slot and another part of the selected key occupying the wheel slot, thereby fixing the angular relationship between the shaft and wheel at the angular offset determined by the particular key selected.

The slot in the wheel hub may be of a width substantially different from the shaft slot width and the wheel hub and shaft may be matingly tapered with the key being captured between the wheel hub and shaft due to a nut threaded to a threaded portion of the small end of the tapered shaft, which nut engages the wheel hub holding the wheel in position on the shaft.

Also in general and in one form of the invention, an arrangement for coupling a tapered engine driven shaft and a flywheel which supports a portion of an engine ignition system at a selectable relative angular orientation to thereby determine engine ignition timing includes at least one keyway in the shaft tapered surface and at least one keyway in the tapered central opening of the wheel hub along with a key arrangement which is effective only when the hub and shaft are joined along their respective tapers to join a hub keyway and a shaft keyway, locking the wheel to the hub in a selected one of a plurality of possible relative angular positions. In one preferred form, the shaft tapered surface and the wheel hub tapered opening each include but a single keyway, and the key arrangement includes a plurality of differing keys, any one of which may join the hub keyway and the shaft keyway, and each one of which provides a different relative angular orientation between the wheel and the shaft.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
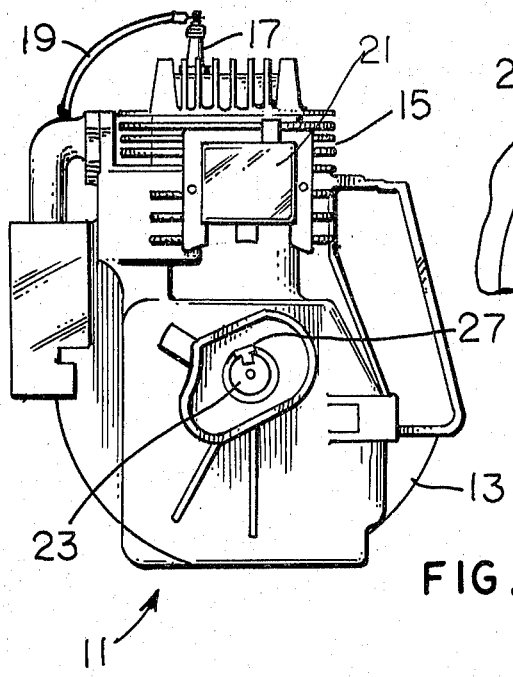
FIG. 1 is a side view of an internal combustion engine, the ignition timing of which may be preset according to the present invention.

Referring now to FIG. 1, an internal combustion engine 11 of conventional construction includes a base portion 13, which may include a crankcase and lubricating oil, with that base portion 13 being relatively fixed as is the air cooled cylinder head 15, which is supported thereon. The internal combustion engine further includes a sparkplug 17 and ignition wire 19 leading from an ignition system 21, which may, for example, be of the type described in the aforementioned two United States Patents. The engine crankshaft 23 rotatably supports a flywheel 25 and, as noted earlier, that flywheel 25 may support a portion of the ignition system. Under those conditions, the relative angular position between the flywheel 25 and crankshaft 23 determines ignition timing.

Figure 2:
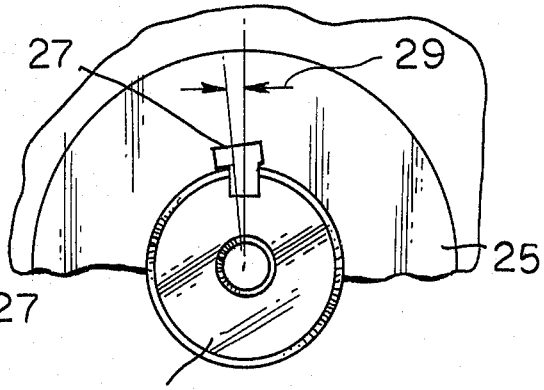
FIG. 2 is an enlarged view of a portion of the flywheel and engine driven shaft of FIG. 1, illustrating one offset key therebetween.

Flywheel 25 and crankshaft 23 are seen in FIG. 2 to be locked together for simultaneous rotation during engine operation by a key 27. Key 27 has a lower portion disposed in a keyway in shaft 23 and an upper portion as viewed disposed in a keyway in the inner hub of flywheel 25. As viewed, the width of the keyway in the hub portion of wheel 25, is larger than the width of the keyway in shaft 23, with the hub keyway spanning the shaft keyway, however those two keyways are not angularly aligned, but rather one keyway is offset from the other by a small angular displacement 29. Forming the hub keyway and shaft keyway of the same width and then introducing some offset such as 29 will substantially diminish the thickness of key material at the interface between the hub and shaft, leading to an increased likelihood of shearing the key along this interface.

Figure 3:
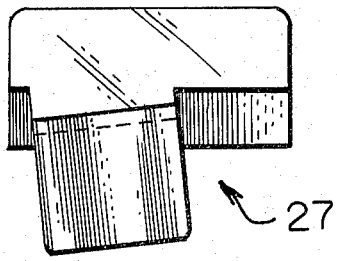
FIG. 3 is an end view of the key of FIG. 2, illustrating the key end opposite that visible in FIG. 2.
Figure 4:
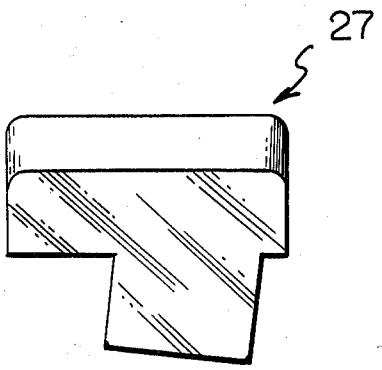
FIG. 4 is an enlarged view of the end of the key illustrated in FIG. 2.
Figure 5:
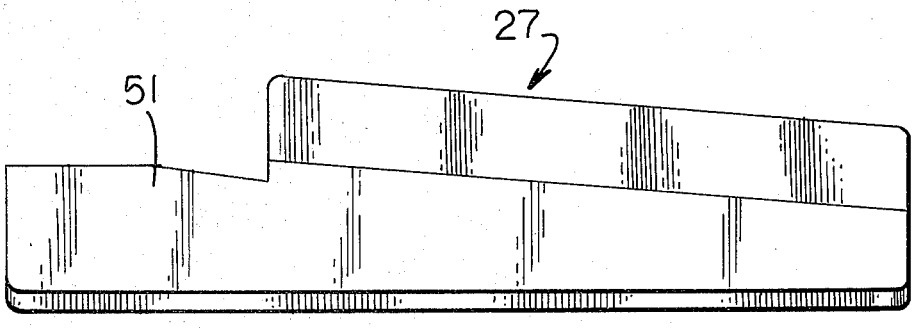
FIG. 5 is a side view of the key illustrated in FIGS. 2, 3 and 4.

Key 27 is illustrated in greater detail in FIGS. 3, 4 and 5, with FIGS. 1, 2 and 4 being from the same direction and in a plane generally perpendicular to the axis of shaft 23. When viewed in this direction, the key cross-section may be thought of as being generally T-shaped, with the T horizontal portion or cross-member being that portion of the key which occupies the wheel hub slot, while the vertical portion of the T is that portion which occupies the shaft keyway. The T is asymmetrical in that the center of the cross member is not aligned with the center of the upright portion of the T, and this misalignment is the angular offset 29 of FIG. 2.

Figure 6:
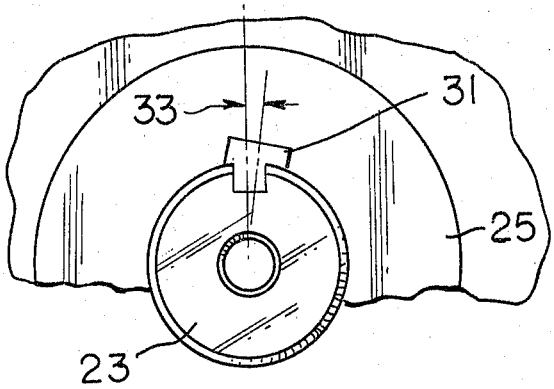
FIG. 6 is a view analogous to FIG. 2, but illustrating a different offset key.
Figure 7:
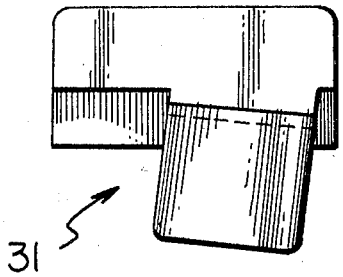
FIG. 7 is a view analogous to FIG. 3, but illustrating the offset key of FIG. 6.

If wheel 25 is removed from shaft 23 and a dissimilar key 31 substituted for key 27, the configuration of FIG. 6 results. In FIG. 6, key 31 provides a relative angular displacement between the center of the hub keyway and the center of the shaft keyway, illustrated by the angle 33. Note that the angular displacement 33 is in a direction opposite the angular displacement 29 of FIG. 2 since key 31 is somewhat the "mirror image" of key 27. Thus, the change in relative angular displacement between FIGS. 2 and 6 is the sum of angles 29 and 33. A key symmetrical in cross-section would, of course, provide the angular displacement 33 of zero.

Figure 9:
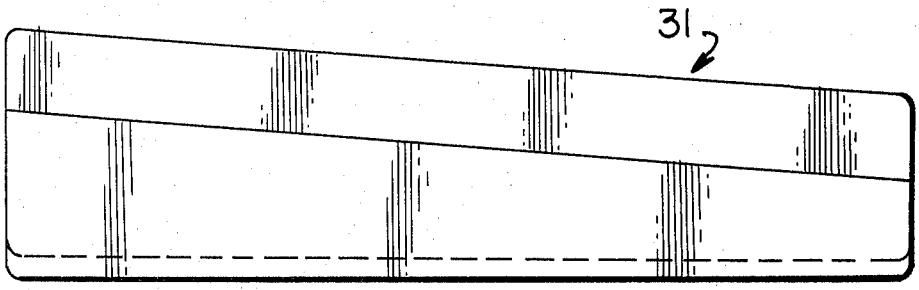
FIG. 9 is a view analogous to the view of FIG. 5, but illustrating the offset key of FIG. 6.
Figure 10:
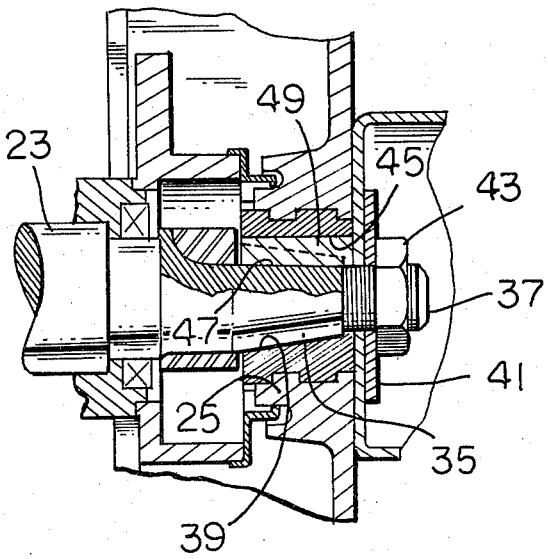
FIG. 10 is a view in cross-section of an engine driven shaft, flywheel, interconnecting key and arrangement for locking the flywheel to the shaft.
Figure 8:
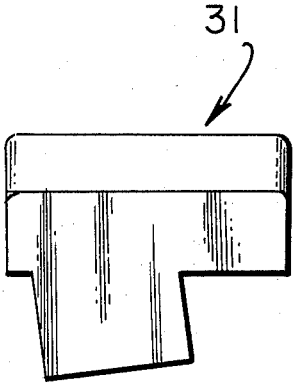
FIG. 8 is a view analogous to the view illustrated in FIG. 4, but illustrating the offset key of FIG. 6.

FIG. 10 is a cross-sectional view cleaving the shaft 23 along its axis of rotation in a plane to intersect the key and flywheel 25. In FIG. 10, the engine driven shaft 23, which may be the engine crankshaft, is seen to include a tapered portion 35 as well as a threaded portion 37 near the small end of the shaft. Wheel 25, typically the engine flywheel, includes a central hub tapered portion 39 which matingly engages the shaft taper 35. Wheel 25 is held snugly against the taper 35 by a washer 41 and nut 43. The wheel hub keyway 45 and the shaft keyway 47 cooperate to confine the key 49 therebetween when the wheel is assembled to the shaft. For manufacturing convenience, the keyway 45 is of a constant depth relative to the tapered surface of the wheel hub 39, and key 49 is somewhat tapered to insure that the key remains captured between the mating shaft and wheel. Thus, key 49 illustrated in FIG. 10 may be key 31 of FIGS. 6 through 9 or it may be key 27 of FIGS. 2 through 5, as well as any other desired offset or symmetrical key. Key 49 might also, for example, be designed as an offset key but without the taper illustrated in FIGS. 5, 9 and 10, so that the flywheel might be removed and key 49 reversed end for end to change the angular relationship between the wheel 25 and shaft 23. A Woodruff type key may also be adapted in this way for accommodating various ignition designs.

Keys 27 and 31 have been described as "mirror images", however, it will be noted that key 27 includes a tail portion 51 which may function to fill the shaft or keyway so that a dust seal, oil seal or other washer-like member may ride about the whaft. This feature will, of course, vary for varying engine designs.

The present invention has been found to be particularly suited to providing the proper angular relationship between a flywheel magnet and an ignition lamination to thereby also provide correct engine timing. In particular, two ignition systems, one a breaker point controlled magneto, and the other a capacitor discharge solid state ignition, both utilizing the same standardized lamination core, and the same flywheel, may be properly timed by selecting the key corresponding to the particular one of these two ignition systems. With these two ignition systems, the flywheel magnet is located at a different angular position for one ignition as compared to the other when the engine crankshaft is in the correct rotative position for firing, and one alternate for matching ignition systems would be to manufacture two otherwise identical flywheels but having a different keyway to magnet angle in each. An extra key is substantially less expensive to handle and stock than a second flywheel.

From the foregoing it is now apparent that a novel engine timing method as well as a novel key system for presetting the ignition timing of an internal combustion engine has been disclosed meeting the objects and advantageous features set out hereinbefore as well as others and that modifications as to the precise configurations, shapes and details as well as the precise steps of the method may be made by those having ordinary skill in the art without departing from the spirit of the invention or the scope thereof as set out by the claims which follow.

What is claimed is:

1. The method of permanently presetting the ignition timing of an internal combustion engine having a rotatable shaft and a wheel supported on the shaft for rotation therewith wherein the engine ignition system includes a relatively fixed portion supported by the engine and a movable portion supported on the wheel for rotation therewith so that the same flywheel and movable ignition portion may be adapted to a selected one of at least two distinct engine types having different relatively fixed ignition portions and requiring dissimilar angular flywheel positions relative to the engine crankshaft to achieve proper engine timing, the method comprising the steps of:

providing a slot in the shaft surface extending generally parallel to the axis of rotation of the shaft;

providing a slot in the wheel along an inner hub thereof and generally alignable with the shaft slot when the wheel is supported on the shaft;

selecting one of a plurality of keys having differing offset amounts with the particular offset selected providing correct ignition timing for the engine; and assembling the wheel to the shaft with one part of the selected key occupying the shaft slot and another part of the selected key occupying the wheel slot to thereby fix the angular relationship between the shaft and wheel at the angular offset determined by the particular key selected.

2. The method of claim 1 wherein the step of providing a slot in the wheel includes forming the slot in the wheel hub to a width substantially greater than the shaft slot width.

3. The method of claim 2 wherein the step of assembling includes positioning the wheel hub on the shaft and aligning the hub slot and the shaft slot so that the center lines of the respective slots are angularly displaced by the angular offset determined by the particular key selected while the sides of the shaft slot remain within the span of the sides of the hub slot.

4. The method of claim 1 wherein the step of assembling includes forcing a tapered portion of the hub onto a mating tapered portion of the shaft to capture the key between the hub and shaft.

5. In an internal combustion engine having an engine driven shaft and a shaft supported wheel for rotatably supporting a portion of the engine ignition system, an improved key arrangement for coupling the shaft and the wheel to permanently fix the relative angular orientation of the wheel and shaft and therefore also permanently fix the ignition timing as determined by the particular key configuration comprising:

first means including a first key portion for fixing the relative position of the key and the shaft;

second means including a second key portion for fixing the relative position of the key and the wheel, one of the key portions being larger than and disposed asymmetrically to the other key portion.

6. The improvement of claim 5 wherein the first means further includes a slot in the shaft surface extending generally parallel to the axis of rotation of the shaft with the first key portion occupying the shaft slot, and the second means further includes a wheel hub having a slot along an inner portion thereof with the second key portion occupying the wheel hub slot.

7. The improvement of claim 6 wherein the width of the wheel hub slot is substantially greater than the width of the shaft slot, the wheel hub slot and shaft slot being generally aligned yet asymmetrically disposed when the wheel is supported on the shaft with the sides of the shaft slot within the span of the sides of the wheel hub slot.

8. The improvement of claim 5 wherein the shaft is tapered and the wheel hub inner portion has a matingly contoured tapered opening, the wheel hub and shaft when joined capturing the key therebetween.

9. The improvement of claim 8 wherein the smaller end of the tapered shaft is threaded to receive a nut for holding the wheel hub in mating engagement with the tapered shaft.

10. The improvement of claim 5 for adaptation to differing ignition systems according to the particular selected key configuration wherein at least two dissimilar keys are included in the key arrangement only one of which may simultaneously occupy the shaft and wheel hub slots at any given time, a first key providing a first relative angular orientation between the wheel and shaft and a second key providing a second relative angular orientation between the wheel and shaft different from the first relative angular orientation.

11. In an internal combustion engine having an engine driven tapered shaft and a shaft supported wheel for rotatably supporting a portion of the engine ignition systems, an improved arrangement for coupling the shaft and wheel at a selectable relative angular orientation to determine the engine ignition timing and to adapt the same flywheel to the selected one of at least two distinct engine types requiring dissimilar angular flywheel positions relative to the engine crankshaft to achieve proper engine timing comprising:

a wheel hub integral with the wheel and having a tapered central opening matable with the tapered shaft for joining the wheel to the shaft;

at least one keyway in the shaft tapered surface;

at least one keyway in the wheel hub tapered central opening; and key means effective only when the hub and shaft are joined with their respective tapers mating to join a hub keyway and a shaft keyway locking the wheel to the shaft in the selected one of a plurality of relative angular positions with the shaft keyway and hub keyway somewhat angularly misaligned by an amount appropriate to the ignition timing requirements of the engine.

12. The arrangement of claim 11 wherein the shaft tapered surface and the wheel hub tapered opening each include but a single keyway, the key means comprising a plurality of differing keys any one of which may join the hub keyway and the shaft keyway and each of which provides a different relative angular orientation between the wheel and the shaft.

* * * * *

UNITED STATES PATENT OFFICE

CERTIFICATE OF CORRECTION

Patent No. 4278054 Dated July 14, 1981

Inventor(s) Kenneth W. Campen

It is certified that error appears in the above-identified patent and that said Letters Patent are hereby corrected as shown below:

Col. 4, line 34, after "shaft" insert -- slot --.

Claim 11, Col. 6, line 33, change "systems" to -- system --.

References Cited: Wilkenson Patent 2,404,617 should be -- 2,404,017

Signed and Sealed this

*Twenty-ninth* Day of *September 1981*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,278,054

DATED : July 14, 1981

INVENTOR(S) : Kenneth W. Campen

It is certified that error appears in the above—identified patent and that said Letters Patent is hereby corrected as shown below:

In the drawings Figure 1 should appear as shown below.

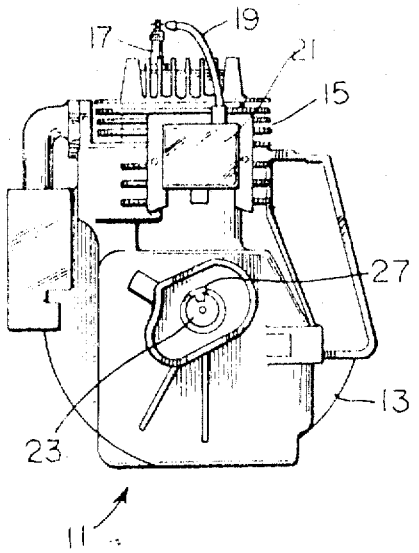

Signed and Sealed this

First Day of December 1981

[SEAL]

Attest:

GERALD J. MOSSINGHOFF

Attesting Officer

Commissioner of Patents and Trademarks